US005841283A

United States Patent [19]

Bloemen

[11] Patent Number: 5,841,283

[45] Date of Patent: Nov. 24, 1998

[54] DISCRIMINATOR CIRCUIT FOR DETECTING THE EVENT SPARK PLUG IN A DISTRIBUTORLESS IGNITION SYSTEM

[75] Inventor: Hendrikus Franciscus Bonifatius Bloemen, Ootmarsum, Netherlands

[73] Assignee: Fluke Corporation, Everett, Wash.

[21] Appl. No.: 909,996

[22] Filed: Aug. 12, 1997

[51] Int. Cl.[6] ..... F02P 17/00

[52] U.S. Cl. ..... 324/399; 324/378; 324/393

[58] Field of Search ..... 324/378, 388, 324/391, 393, 397, 399

[56] References Cited

U.S. PATENT DOCUMENTS

| | | | |
|---|---|---|---|
| 5,510,715 | 4/1996 | Takeuchi | 324/391 |
| 5,548,220 | 8/1996 | Kawamoto et al. | 324/399 |
| 5,727,534 | 3/1998 | Kondo et al. | 324/399 X |

*Primary Examiner*—Glenn W. Brown

[57] ABSTRACT

A discriminator circuit for detecting an event spark plug in a distributorless ignition system. The voltage waveform during event and waste cycles of the ignition system is conditioned and applied to a pair of comparators which compare the voltage waveform with different voltage reference levels. Both comparators switch states to a logical high level upon the firing of the event spark plug. The first comparator switches back to a low logical state after the end of the burn time in the event cycle. The second comparator remains in a high logic state following the burn time in the event cycle due to the negative voltage remaining on the spark cable, but switches back to a low logical state after the firing of the event spark plug in the waste cycle when the voltage on the spark plug cable goes positive. A delay element connected to the output of the first comparator holds the output of the first comparator at the high logical for a predetermined time period that is longer than the burn time in the event cycle. When the output of the delay element and the output of the second comparator are both at a logical high state, a gate passes the logical high as an indication signal of detection of the event spark plug. A second delay element may be interposed between the output of the first timer and the logic gate to determine the pulse width of the indication signal.

3 Claims, 1 Drawing Sheet

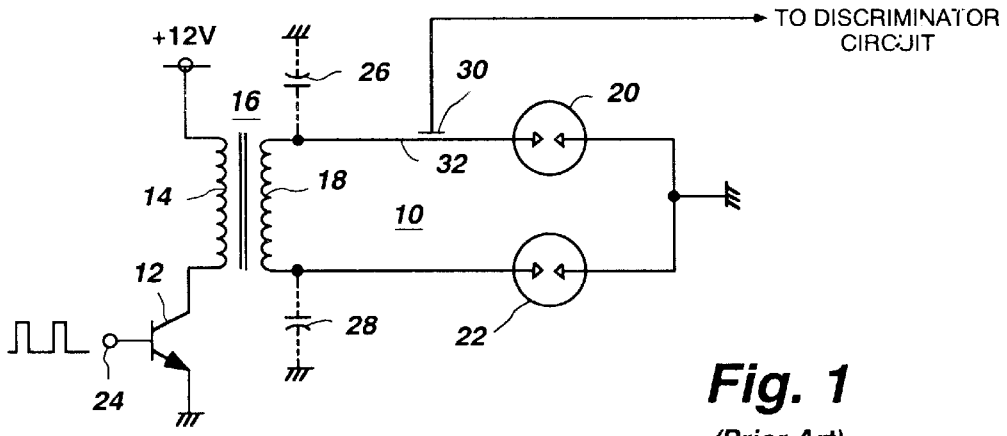
Fig. 1
(Prior Art)
Fig. 2A
Fig. 2B
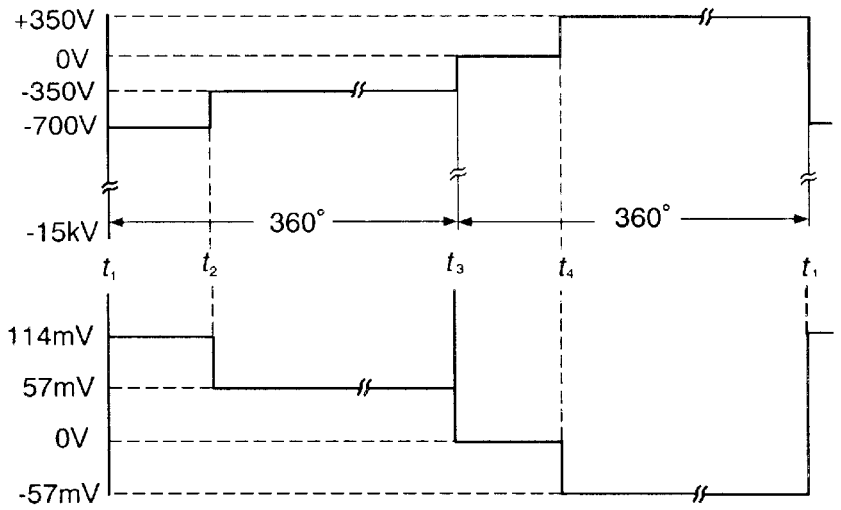
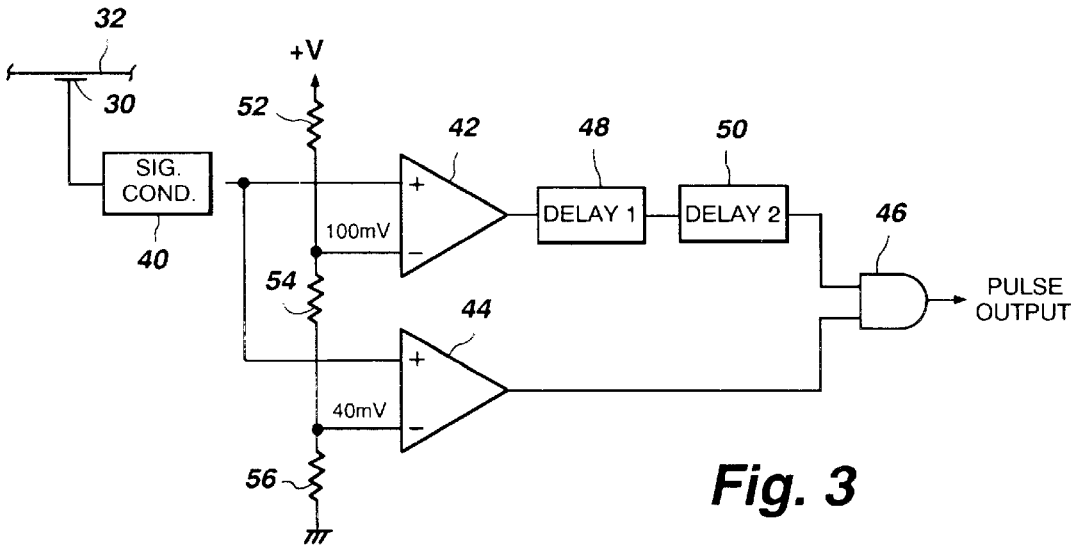
Fig. 3

DISCRIMINATOR CIRCUIT FOR DETECTING THE EVENT SPARK PLUG IN A DISTRIBUTORLESS IGNITION SYSTEM

BACKGROUND OF THE INVENTION

This invention relates generally to discriminator circuits, and in particular to a discriminator circuit for detecting the event spark plug in a distributorless ignition system.

In diagnosing faults in the ignition system of an internal combustion engine, it is common to use an oscilloscope to view the voltage pulse of each spark plug. By triggering the oscilloscope on the firing pulse of No. 1 cylinder, for example, the voltage pulses of all of the spark plugs may be displayed in correct firing sequence. Malfunctions such as a bad spark plug, a blown ignition coil, or a defective spark plug cable can readily be discerned from the shape of the pulse.

In conventional ignition systems using distributors, each spark plug fires once in the firing sequence. A voltage pulse is easily obtained from the spark plug of any cylinder, for example, from No. 1 cylinder for triggering purposes, by use of a magnetic pick-up sensor.

However, in distributorless ignition systems, such as those used in modern automobiles, cylinders are arranged in pairs with the respective spark plugs thereof connected in series and sharing a coil pack. That is, the spark plugs form a closed loop with the secondary winding of an ignition coil, and a ground connection, typically the engine block, is interposed between the spark plugs. Consequently, the spark plugs each fire twice during an ignition cycle; they fire once on a compression or working stroke, and again on an exhaust stroke. These two strokes have become known in the art as the "event" stroke and the "waste" stroke.

It would be desirable to recognize the voltage pulse associated with only the event stroke while ignoring the voltage pulse associated with the waste stroke in analyzing the spark plug voltage pulses. In particular, it would be desirable to generate a trigger signal upon the event stroke of No. 1 cylinder for triggering an oscilloscope.

SUMMARY OF THE INVENTION

In accordance with the present invention, a discriminator circuit for detecting the event spark plug in a distributorless ignition system recognizes the voltage pulse associated with event stroke while ignoring the voltage pulse associated with the waste stroke.

The ignition voltage signal on the event spark plug cable during event and waste cycles of the ignition system is conditioned and applied to a pair of comparators which compare the voltage waveform with reference voltages having different amplitudes. Both comparators switch states to a logical high level upon the firing of the event spark plug because upon such firing the voltage waveform exceeds the amplitudes of both reference voltages. The first comparator switches back to a low logical state when the ignition voltage signal drops below the amplitude of the reference voltage applied to the first comparator, which may occur after the end of the burn time in the event cycle. The second comparator remains in a high logic state following the burn time in the event cycle because the amplitude of the reference voltage applied to the second comparator is less than the voltage on the spark plug cable during the event cycle, but switches back to a low logical state after the firing of the event spark plug in the waste cycle when the voltage on the spark plug cable drops to zero. A delay element, such as a timer, connected to the output of the first comparator maintains the output of the first comparator at the high logical for a predetermined time period, e.g., three milliseconds, that is longer than the burn time in the event cycle (typically 1.5 to 2.5 milliseconds). When the output of the timer and the output of the second comparator are both at a logical high state, a gate passes the logical high as an indication signal of detection of the event spark plug. A second delay element, which may be another timer, may be interposed between the output of the first timer and the logic gate to determine the pulse width of the indication signal. The output pulse of the gate may be utilized as the trigger signal for an oscilloscope. Of course, if the waveform of the event spark plug is to be viewed on the oscilloscope screen, an appropriate time delay between the signal pickup and the oscilloscope input will have to be inserted to compensate for the three-millisecond delay in generating the trigger signal.

It is therefore one object of the present invention to detect firing of a spark plug during the event stroke in a distributorless ignition system while ignoring firing of the same spark plug during the waste stroke.

It is another object to provide a discriminator circuit for detecting an event spark plug in a distributorless ignition system having alternating event and waste ignition cycles.

It is a further object to provide a discriminator circuit for generating a trigger signal upon detection of the firing of a spark plug during the event stroke in a distributorless ignition system.

Other objects, features, and advantages of the present invention will become obvious to those having ordinary skill in the art upon a reading of the following description when taken in conjunction with the accompanying drawings.

BRIEF DESCRIPTION OF THE DRAWINGS

FIG. 1 is a schematic diagram of a partial distributorless ignition system for an internal combustion engine;

FIG. 2A is a typical waveform of the voltage on a spark plug cable through one complete engine cycle for explaining the system of FIG. 1;

FIG. 2B is a conditioned and inverted version of the waveform of the voltage in FIG. 2A as the input of the discriminator circuit of FIG. 3; and FIG. 3 is a discriminator circuit in accordance with the present invention.

DETAILED DESCRIPTION OF THE INVENTION

Referring to FIG. 1 of the drawings, there is shown a schematic diagram of a prior art partial distributorless ignition system 10 for an internal combustion engine. A transistor 12 is connected in series with the primary winding 14 of ignition coil 16 between +12 volts at one end of primary winding 14 and ground at the emitter of transistor 12. The secondary winding 18 of coil 16 is connected in series with a first spark plug 20 and a second spark plug 22 to form a loop which is grounded, for example, through the engine block, between the spark plugs 20 and 22. Transistor 12 receives primary ignition pulses from an ignition module (not shown) applied to the base thereof at a terminal 24, switching on and saturating in response thereto, providing saturation current to primary winding 14 and creating a magnetic field on the ignition coil primary.

When transistor 12 is switched off, a high voltage on the order of from −15 to −40 kilovolts, depending on the system, is created across secondary winding 18 as the magnetic field collapses, causing both spark plugs 20 and 22 to fire. The spark plugs are arranged in pairs such that both spark plugs fire simultaneously. One spark plug fires on the event stroke and the other fires on the waste stroke. Consequently, both park plugs fire twice on each engine cycle of two revolutions.

Capacitors 26 and 28, connected respectively to the opposite ends of secondary winding 18 by dashed lines, represent parasitic capacitances in the system which continue to hold voltages after the spark plugs fire. The spark plugs in system 10 may be monitored by means of a capacitive pickup on each of the cables that allows the waveform of each spark plug to be applied to an oscilloscope for viewing and analysis. A capacitive pickup 30 is shown on the cable 32 of spark plug 20 to facilitate monitoring and utilization of signals on the spark plug cable 32, and more particularly, for generating a trigger signal upon the detection of the firing of spark plug 20 during the event stroke. The signals obtained by capacitive pickup 30 will be discussed below in connection with FIGS. 2B and 3.

It should be noted for complete understanding of the partial ignition system shown that for a four-cylinder engine, two such systems 10 are required, with spark plug 20 representing No. 1 cylinder and spark plug 22 representing No. 4 cylinder. Likewise, for a six-cylinder engine, three such systems 10 are required, and for an eight-cylinder engine, four such systems 10 are required. Each pair of spark plugs is arranged in pairs such that one plug fires on the event stroke while the other fires on the waste stroke.

FIG. 2A is a typical waveform of the voltage signal on a spark plug cable through one complete ignition cycle of an engine for explaining the system of FIG. 1. For purposes of this explanation, assume that this is the voltage signal waveform on the cable 32 of spark plug 20, and that spark plug 20 is associated with No. 1 cylinder. As mentioned earlier, capacitors 26 and 28 represent parasitic capacitance of the system at either end of the coil 16. At time $t_1$, a nominal −15-kilovolt high voltage pulse is developed across the secondary winding 18 of coil 16. Spark plug 20 fires (as does spark plug 22), igniting the compressed flammable fuel mixture in No. 1 cylinder. Capacitor 26 is charged to a nominal −700 volts, and there remains until extinction of the spark at time $t_2$. The time from $t_1$ to $t_2$ is referred to as the "burn time," and the voltage (nominal −700 volts in this case) during this period is referred to the "burn voltage." The burn time typically lasts on the order of 1.5 to 2.5 milliseconds. The burn voltage, of course, burns the fuel mixture in the cylinder during the working stroke of the engine.

After extinction of the spark of spark plug 20 at time $t_2$, the voltage is distributed equally across capacitors 26 and 28, so that the voltage on the cable of spark plug 20 over the remaining portion of the crankshaft revolution (360°) is approximately −350 volts.

At time $t_3$, secondary winding 18 of coil 16 again produces a nominal −15-kV high voltage pulse. Spark plug 20 again fires (as does spark plug 22), but this time the fuel mixture in No. 4 cylinder is ignited. No. 1 cylinder is in the exhaust or waste cycle, so the firing of spark plug 20 has no effect, and is thus wasted. The voltage on the cable of spark plug 20 is pulled up to zero volts as capacitor 28 charges to +700 volts. After extinction of the spark of spark plug 22 at time $t_4$, the voltage is again distributed equally across capacitors 26 and 28, so that the voltage on the cable of spark plug 20 from time $t_4$ to the start of a new cycle at time $t_1$ is nominally +350 volts.

FIG. 2B is a conditioned and inverted version of the waveform of the voltage signal in FIG. 2A applied as the input of the discriminator circuit of FIG. 3. Looking for a moment at FIG. 3, there is shown a capacitive pickup 30 on a spark plug cable 32 as was shown in FIG. 1. The output voltage signal of capacitive pickup 30 is applied to a signal conditioning (SIG. COND.) circuit 40 where it is filtered, amplified, and inverted to produce the waveform shown in FIG. 2B. The output voltage signal of capacitive pickup 30, depending on the particular system, is on the order of about 20 to 100 millivolts per kilovolt of that on spark plug cable 32. The amplification gain of signal conditioning circuit 40 should be selected so that voltage levels appearing in the discriminator circuit are compatible with components and reference voltages that are selected to result in proper operation of the discriminator circuit. For example, in a system that was tested, the voltage sensitivity was about 30 mV/kV and the amplification gain of signal conditioning circuit was selected to be about five, so that a spark plug cable 32 voltage of −700 volts appearing at the output of signal conditioning circuit 40 results in about +114 millivolts (mV) being applied to the discriminator circuit. Likewise, the magnitude of 350 volts results in about 57 mV at the output of signal conditioning circuit 40. These signal levels will be used in connection with the following description of the operation of the discriminator circuit.

The discriminator circuit comprises a first comparator 42 and a second comparator 44, the outputs of which are connected through respective first and second paths to the inputs of an AND gate 46. The output of first comparator 42 is connected to a first delay element (DELAY 1) 48. Delay element 48 may suitably be a timer. A second delay element (DELAY 2) 50 may suitably be connected in the path between the output of first delay element 48 and the input of AND gate 46. The inverting inputs of first and second comparators 42 and 44 are connected to respective reference voltage levels provided by a voltage divider comprising resistors 52, 54, and 56 connected in series between a voltage source and ground. For operation of this particular circuit, the reference voltage applied to the inverting input of first comparator 42 is +100 mV, while the reference voltage applied to the inverting input of second comparator 44 is +40 mV.

The discriminator circuit in accordance with the present invention operates as follows: At time $t_1$ in FIGS. 2A and 2B, the voltage applied to the non-inverting (+) inputs of first and second comparators 42 and 44 rises to +114 mV, exceeding the reference voltages at the inverting (−) inputs thereof, causing both comparators to switch to a logical high state. The first delay element 48 is activated. In the preferred embodiment, the delay element is a timer that begins counting. The output of the second delay element 50, which also is a timer in the preferred embodiment, is at a logical low state at this juncture, so the output of AND gate 46 remains at a logical low state. After about 3 milliseconds, which is slightly longer than the burn time which ends at time $t_2$, the output of first delay element 48 switches states, activating second delay element 50. When second delay element 50 is activated, the output thereof switches to a logical high. In the meantime, at time $t_2$, the voltage at the non-inverting inputs of first and second comparators dropped from +114 mV to +57 mV as the parasitic capacitances (capacitors 26 and 28 in FIG. 1) equalized, switching the output of first comparator 42 back to its low state. However, since the voltage at the non-inverting input of second comparator 44 continues to exceed the reference level of +40 mV, the output of second comparator 44 remains at its high state. With a logical high at both inputs of AND gate 46, the output thereof switches to a logical high state. When the timer of second delay element 50 reaches its terminal count, after one millisecond in this embodiment, the output thereof switches to a logical low state. AND gate 46, with a logical low and a logical high applied to its inputs, switches its output to a logical low state.

Thus it can be discerned that a pulse output is produced at the output of AND gate 46 having a pulse width that is determined by second delay element 50. In this regard, it can readily be seen that second delay element 50 is not really necessary to operation of the discriminator, and could be either eliminated if the output of first delay element 48 produced a logical high at the end of its delay, or terminal count in the case of a timer, or replaced by an inverting amplifier if the pulse width at the output of AND gate 46 is irrelevant. The pulse output of AND gate 46 may suitably be used as the trigger pulse for an oscilloscope.

To see what happens at time $t_3$, observe that any spike that rises above 100 mV will cause both first comparator 42 and second comparator 44 to switch states, that is, switch to a logical high momentarily. Immediately thereafter, however, ignition voltage on cable 32, and hence at the input of the discriminator circuit, will drop to zero volts, and the output of second comparator 44 will switch back to its low state. While first delay element 48 will be activated on the momentary high logic state at the output of comparator 42, it will be about three milliseconds before a logical high will be applied via second delay element 50 to AND gate 46. At that point in time, however, after time $t_4$, the inverting input of second comparator 44 will be at −57 mV because of the positive-going waste voltage on cable 32, holding the output of comparator 44, and consequently, the second input of AND gate 46, at a logical low.

From the foregoing, it can be discerned that the discriminator circuit of the present invention takes advantage of the voltages appearing on cable 32, particularly the negative voltage following the burn time of an event stroke and the positive voltage following the burn time of a waste stroke, and detects the event stroke of a spark plug while ignoring the waste stroke in a distributorless ignition system, producing a signal only upon detection of the working or event firing of the spark plug.

It should be noted that the voltages of automotive systems vary widely, and the voltages described herein were chosen merely for purposes of explanation. In a commercial embodiment, the reference voltage levels applied to the first and second comparators could be made variable or even programmable to match the system being analyzed. Moreover, the discriminator herein described is in the context of detecting, for example, the spark ignition for cylinder No. 1 in a four-cylinder engine with a distributorless ignition system, the principles may be applied equally well to engines having other cylinder configurations.

While I have shown and described the preferred embodiment of my invention, it will be apparent to those skilled in the art that many changes and modifications may be made without departing from my invention in its broader aspects. For example, the delay elements described herein could be delay lines. It is therefore contemplated that the appended claims will cover all such changes and modifications as fall within the true scope of the invention.

What I claim as my invention is:

1. A discriminator circuit for detecting an event spark plug in a distributorless ignition system having said event spark plug and a waste spark plug connected in series to form a closed loop with a secondary winding of an ignition coil, wherein a spark plug cable is interposed between said secondary winding and said event spark plug and carries a voltage signal representative of alternating event and waste ignition cycles, comprising:

a first comparator having a first input thereof coupled to said spark plug cable and receiving said voltage signal, and a second input thereof coupled to a first reference voltage, said first comparator switching from a first to a second logic state at the output thereof when said voltage signal exceeds said first reference voltage upon the firing of said event spark plug, and said first comparator switching back to said first logic state when said voltage signal at said first input thereof falls below said first reference voltage after the firing of said event spark plug;

a delay element having a delay input connected to the output of said first comparator and generating at a delay output said second logic state after a predetermined time period following receipt of said second logic state at said delay input;

a second comparator having a first input thereof coupled to said spark plug cable and a second input thereof coupled to a second reference voltage, said second comparator switching from said first to said second logic state at the output thereof when said signal voltage at said first input thereof exceeds said second reference voltage at the beginning of said event cycle, said second comparator switching back to said first logic state when said voltage signal at said first input thereof representing waste voltage in said waste ignition cycle falls below said second reference voltage; and a logic gate having a first input coupled to the delay output of said delay element and a second input coupled to the output of said second comparator, said logic gate producing said second logic state at an output thereof indicating detection of said event spark plug when both said first and second inputs of said logic gate are at said second logic state.

2. A discriminator in accordance with claim 1 wherein said delay element is a timer.

3. A discriminator in accordance with claim 1 further comprising a second delay element coupled to the output of said first timer to cause the output of said logic gate to remain at said second logic state only for the time period determined by said second timer.

* * * * *